US011821273B1

(12) United States Patent
Zhang et al.

(10) Patent No.: US 11,821,273 B1
(45) Date of Patent: Nov. 21, 2023

(54) EXPERIMENTAL SYSTEM AND A METHOD FOR WELLBORE PRESSURE TESTING UNDER THE COEXISTENCE OF GAS-KICK AND LOSS-CIRCULATION

(71) Applicant: Southwest Petroleum University, Chengdu (CN)

(72) Inventors: Jie Zhang, Chengdu (CN); Xin Li, Chengdu (CN); Zhilin Li, Chengdu (CN); Qiang Wei, Chengdu (CN); Xianjie He, Chengdu (CN); Wenqing Ye, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 17/896,219

(22) Filed: Aug. 26, 2022

(30) Foreign Application Priority Data

Jul. 28, 2022 (CN) ..... 202210899275.8

(51) Int. Cl.
*E21B 21/08* (2006.01)
*E21B 21/10* (2006.01)

(52) U.S. Cl.
CPC ..... *E21B 21/08* (2013.01); *E21B 21/10* (2013.01); *E21B 2200/20* (2020.05)

(58) Field of Classification Search
CPC ..... E21B 21/08; E21B 21/10; E21B 2200/20
USPC ..... 703/10
See application file for complete search history.

(56) References Cited

U.S. PATENT DOCUMENTS 3,712,129 A * 1/1973 Rhoades ..... E21B 47/06 73/152.53
4,252,015 A * 2/1981 Harbon ..... G01L 11/006 73/302
6,484,816 B1 * 11/2002 Koederitz ..... E21B 21/08 175/48
7,158,886 B2 * 1/2007 Hou ..... E21B 21/085 702/9

(Continued)

FOREIGN PATENT DOCUMENTS

CN 102402184 A 4/2012
CN 104213906 A 12/2014

(Continued)

*Primary Examiner* — Iftekhar A Khan
(74) *Attorney, Agent, or Firm* — Nitin Kaushik

(57) ABSTRACT

The invention discloses an experimental system and a method for wellbore pressure testing under the coexistence of gas-kick and loss-circulation, comprising a drill string simulator, a wellbore simulator and a complex stratigraphic structure simulator communicated in sequence from top to bottom; further comprising a medium return pipeline for collecting the returning test liquid and a medium leakage module for collecting the leaking test liquid; further comprising a data acquisition system for collecting data during testing. In the present invention, the experimental system has a simple structure, and the experimental method can comprehensively cover the three stages of circulating, well shut-in and well killing during the occurrence of coexistence of gas-kick and loss-circulation, multiple groups of experiments can be conducted by changing a single variable at the same stage, thus making the experimental test results applicable to all stages of wellbore pressure control in drilling operation.

9 Claims, 6 Drawing Sheets

(56) References Cited

U.S. PATENT DOCUMENTS

| | | | | |
|---|---|---|---|---|
| 9,260,930 | B2 * | 2/2016 | Smith | E21B 34/14 |
| 9,631,444 | B1 * | 4/2017 | Sun | E21B 47/06 |
| 10,787,883 | B2 * | 9/2020 | Montoya | E21B 33/04 |
| 11,242,742 | B2 * | 2/2022 | Andresen | E21B 47/06 |
| 2003/0139916 | A1 * | 7/2003 | Choe | E21B 41/0007 703/10 |
| 2006/0272810 | A1 * | 12/2006 | Marsh | E21B 33/10 166/66 |
| 2012/0006613 | A1 * | 1/2012 | Tseytlin | E21B 21/08 181/106 |
| 2014/0123747 | A1 * | 5/2014 | Veeningen | E21B 47/001 73/152.51 |
| 2017/0356284 | A1 * | 12/2017 | Veeningen | E21B 49/008 |
| 2018/0196446 | A1 * | 7/2018 | Imel | F16K 37/0083 |
| 2018/0328128 | A1 * | 11/2018 | Ravi | E21B 33/14 |
| 2019/0094199 | A1 * | 3/2019 | Shi | G06F 17/11 |
| 2019/0360292 | A1 * | 11/2019 | Boyd | E21B 34/02 |
| 2019/0390525 | A1 * | 12/2019 | Keith | E21B 21/08 |
| 2019/0390545 | A1 * | 12/2019 | Poe, Jr. | E21B 49/003 |
| 2020/0362650 | A1 * | 11/2020 | Li | E21B 47/06 |
| 2021/0102460 | A1 * | 4/2021 | Dubs | E21B 21/10 |
| 2021/0348461 | A1 * | 11/2021 | Teixeira | E21B 47/06 |
| 2023/0085283 | A1 * | 3/2023 | Wang | E21B 7/12 175/5 |

FOREIGN PATENT DOCUMENTS

| | | | |
|---|---|---|---|
| CN | 207528706 | U | 6/2018 |
| CN | 109209269 | A | 1/2019 |

* cited by examiner

EXPERIMENTAL SYSTEM AND A METHOD FOR WELLBORE PRESSURE TESTING UNDER THE COEXISTENCE OF GAS-KICK AND LOSS-CIRCULATION

CROSS-REFERENCE TO RELATED APPLICATIONS

The application claims priority to Chinese patent application No. 202210899275. 8, filed on Jul. 28, 2022, the entire contents of which are incorporated herein by reference.

TECHNICAL FIELD

The invention relates to the technical field of wellbore pressure control of deep-sea, deep and ultra-deep oil and gas wells with complex operational and geological conditions, in particular to an experimental system and a method for wellbore pressure testing under the coexistence of gas-kick and loss-circulation.

BACKGROUND

Oil and natural gas are important fossil energy and strategic resources for the well-being of people, the stability of society and the long-term peace and security of nations. The rapid development of global economic, manufacturing and construction levels brings about dramatic increase in the demand for oil and gas resources by mankind and society. Therefore, further improvement in the utilization of deep-sea, deep and ultra-deep oil and gas resources is an important strategic measure to address the insufficient energy supply in social development in the current context where conventional fossil energy is still the primary energy supply to maintain a stable social environment. Generally deep-sea, deep and ultra-deep oil and gas wells are accompanied by complex operating conditions such as narrow or no safe mud density range, and uncased hole intervals often have complex geological conditions with developed pores and fractures. Under the above complex conditions, if the wellbore pressure of deep-sea, deep and ultra-deep oil and gas wells is not properly controlled in the drilling process, or if no appropriate technical measures are taken in a timely manner to deal with the complex working conditions, it is very likely to cause the coexistence of gas-kick and loss-circulation. The coexistence of the intrusion of formation fluid into the wellbore and the loss of working fluid from the wellbore to the formation within the same uncased hole interval can cause inestimable damage to the safety of personnel, the surrounding environment and the economic efficiency of the drilling site.

The currently existing technical theories used to analyze and resolve the complex challenge of coexistence of gas-kick and loss-circulation are in essence drawn from the practical field experience gained by summarizing the temporary technical measures taken under specific conditions, unfortunately having major limitations in the analysis and solution of similar problems. Some scholars have also studied the coexistence of gas-kick and loss-circulation due to gravity displacement, but their focus lies in the evolution characteristics of the displacement interface between the working fluid in the wellbore and the formation fluid when gravity displacement occurs downhole, rather than qualitative and quantitative analysis of the evolution characteristics of wellbore pressure under the effect of various pressure differences. On the other hand, the coexistence of gas-kick and loss-circulation due to gravity displacement is a specific complex condition that only occurs when the formation fractures are sufficiently open to provide sufficient downhole displacement space for two-phase fluids. At present, there is neither applicable experimental system nor method for wellbore pressure under coexistence of gas-kick and loss-circulation.

SUMMARY

In order to solve the problems in the prior art, the present invention provides an experimental system and a method for wellbore pressure testing under the coexistence of gas-kick and loss-circulation.

The technical solution employed in present invention is described as follows:

An experimental system for wellbore pressure testing under the coexistence of gas-kick and loss-circulation, comprising a drill string simulator, a transparent wellbore simulator and a transparent complex stratigraphic structure simulator, wherein the complex stratigraphic structure simulator is attached below the wellbore simulator, and the drill string simulator is sleeved inside the wellbore simulator and the complex stratigraphic structure simulator, with the upper end extending out of the wellbore simulator;

Further comprising a liquid conveying module for providing the liquid used in the experimental system and a gas conveying module for providing the gas used in the experimental system, wherein the liquid conveying module is composed of a positive circulating liquid conveying pipeline connected to a liquid storage tank at one end and to the upper end of the drill string simulator at the other end, and a reverse circulating liquid conveying pipeline connected to the liquid storage tank at one end and the wellbore simulator at the other end; the gas conveying module comprises two gas conveying pipelines of the same structure, both with the head end connected to the nitrogen cylinder and the rear end connected to the upper position of the complex stratigraphic structure simulator;

Further comprising a medium return pipeline for collecting the returning test liquid and a medium leakage module for collecting the leaking test liquid, wherein one end of the medium return pipeline is connected to the upper end of the wellbore simulator and the other end is connected to the liquid storage tank through a gas-liquid separator; the medium leakage module comprises two medium leakage pipelines of the same structure, both with the head end connected to the lower part of the complex stratigraphic structure simulator and the rear end connected to the recovery tank;

Further comprising a data acquisition system which is composed of a flowmeter used for acquiring the flow rate and a pressure sensor for acquiring the liquid pressure in the liquid conveying process of liquid conveying module and in the gas conveying process of gas conveying module, a flowmeter used for acquiring the flow rate in the medium return pipeline and the medium leakage pipeline and a pressure sensor for acquiring the gas pressure of the two pipelines, a riser pressure sensor used for acquiring the pressure of the drill string simulator, a casing pressure sensor used for acquiring the pressure during the testing of the wellbore simulator, and a high-speed camera used to capture images of liquid annulus flow between the wellbore simulator and the drill string simulator, wherein the flowmeters, pressure sensors and high-camera are connected to the processing device via a paperless recorder.

Further, the liquid conveying module comprises a liquid conveying pipeline with one end connected to a liquid storage tank through a self-priming variable frequency screw pump and the other end connected to a positive circulating liquid conveying pipeline and a reverse circulating liquid conveying pipeline through a three-way valve; the liquid conveying pipeline is also provided with an electric liquid injection volume control valve and an injected liquid turbine flowmeter; the positive circulating liquid conveying pipeline is provided with a positive circulating injection control valve at the end near the three-way valve end; the reverse circulating liquid conveying pipeline is provided with a reverse circulating injection control valve at the end near the three-way valve end, and provided with a reverse circulating end control valve at the end near the wellbore simulator.

Further, a two-stage pressure regulating valve, a digital mass flowmeter, a ferrule type check valve and an annular pressure sensor at gas conveying point are arranged in sequence from one end of the nitrogen cylinder to the other end on the gas conveying pipeline.

Further, an annular pressure sensor at leakage point, a ferrule type relief valve, a leakage medium turbine flowmeter and a secondary safeguard control valve are sequentially arranged on the medium leakage pipeline.

Further, the medium return pipeline is provided with a return medium turbine flowmeter and an electric return volume control valve.

Further, the drill string simulator and the wellbore simulator are connected through a return medium blowout preventer; the return medium blowout preventer is composed of an upper flange, a central chamber and a lower flange; the drill string simulator passes through the central holes of the upper flange and the lower flange successively; the opposite sides of the central chamber are respectively provided with a left branch pipe and a right branch pipe, the left branch pipe is connected to the reverse circulating end control valve, and the right branch pipe is communicated with the medium return pipe.

Further, the complex stratigraphic structure simulator consists of a housing cavity and a central pipe with uniformly distributed openings set inside thereof; the central pipe with uniformly distributed openings is vertically provided with N slits, and there are openings evenly distributed between adjacent slits along the axial direction of the central pipe with uniformly distributed openings; the gas conveying pipeline is communicated with the first branch pipe arranged on the housing cavity; the medium leakage pipeline communicated with the second branch pipe arranged on the opposite side of the housing cavity.

An experimental method for an experimental system for wellbore pressure testing under the coexistence of gas-kick and loss-circulation, including the following steps:

Step 1: Connect the system and add the prepared liquid in the liquid storage tank; set the electric liquid injection volume control valve, the positive circulating injection control valve and the electric return volume control valve to fully open, keep all other control valves on the pipe closed, and set the safety pressure of the ferrule type relief valve to the maximum;

Step 2: Turn on the self-priming variable frequency screw pump to the maximum liquid injection displacement, and check the tightness of the experimental system; if there is no liquid leakage, adjust the displacement of the self-priming variable frequency screw pump to the set value;

Step 3: After the transient pressure data shown by the annular pressure sensor at gas conveying point and the annular pressure sensor at leakage point are stabilized, adjust the output pressure of the two-stage regulating valve and the safety pressure of the ferrule relief valve simultaneously to the set experimental values according to the equivalent density difference set in the experimental test;

Step 4: Open the nitrogen cylinder, turn on the secondary safeguard control valve, and set the output pressure of the nitrogen cylinder to the set value; start up the data acquisition system, and record the various transient pressures of the experimental test after the transient pressure of the annular pressure sensor at leakage point obtained by the processing device meets the requirements, to complete the circulating simulation test;

Step 5: Turn off the self-priming variable frequency screw pump and the electric return volume control valve, and record the various transient pressures of the experimental test after the transient pressure of the annular pressure sensor at leakage point obtained by the processing device meets the requirements, to complete the shut-in simulation test;

Step 6: Acquire the density of the liquid medium used in the well-kill simulation test and adjust the liquid in the liquid storage tank according to the density; start the self-priming variable frequency screw pump, adjust the opening of the electric return volume control valve to make the transient pressure data obtained by the casing pressure sensor consistent with the transient pressure data acquired in Step 5, and continually adjust the self-priming variable frequency screw pump until it reaches the set value;

Step 7: In the process of the liquid medium flowing from the top of the drill string simulator to the bottom, keep the liquid injection displacement of the self-priming variable frequency screw pump unchanged, and adjust the electric return volume control valve to gradually decrease the transient pressure data obtained from the riser pressure sensor;

Step 8: In the process of the liquid-phase fluid medium flowing upward from the bottom along the annulus between the wellbore simulator and the drill string simulator, keep the liquid injection displacement of the self-priming variable frequency screw pump unchanged, and adjust the electric return volume control valve to equalize the data acquired by the riser pressure sensor with the final transient data in Step 7.

Step 9: When the liquid flows out of the medium leakage pipeline steadily, adjust the safety pressure of the ferrule type relief valve to the maximum value; when the liquid flows out from the medium return pipeline, slowly shut down the self-priming variable frequency screw pump and the electric return volume control valve; record the transient experimental data with the processing device;

Step 10: Inject the set liquid-phase fluid medium into the liquid storage tank, turn on the self-priming variable frequency screw pump, and adjust the opening of the electric return volume control valve to make the transient data acquired by the riser pressure sensor equal to the final transient data obtained in Step 7 until the liquid injection displacement of the self-priming variable frequency screw pump reaches the set value;

Step 11: When the liquid flows out from the medium return pipeline, adjust the opening of the electric return volume control valve to keep the transient data acquired by the casing pressure sensor stable;

Step 12: Repeat Steps 6 to 9;

Step 13: Adjust the liquid in the liquid storage tank, repeat Steps 1 to 12, and adjust the relative positions of the gas pipe and the medium leakage pipeline; then repeat Steps 1 to 12 to complete the experiment.

Further, the maximum liquid injection displacement of the self-priming inverter screw pump in Step 2 is calculated as follows:

$$\begin{cases} \text{Laminar flow} & Q_{1,max} = \alpha\pi\left(R_{w,m}^2 - R_{p,m}^2\right)\dfrac{(P_{w,m} - 9.81\rho_{1,m}h_{w,m})(R_{w,m} - R_{p,m})^2}{12\mu_{1,m}h_{w,m}} \\ \text{Turbulent flow} & Q_{1,max} = \alpha\pi\left(R_{w,m}^2 - R_{p,m}^2\right)\sqrt{\dfrac{(P_{w,m} - 9.81\rho_{1,m}h_{w,m})(R_{w,m} - R_{p,m})}{fh_{w,m}\rho_{1,m}}} \end{cases}$$

Where, $Q_{1,max}$ is the maximum injection and displacement volume of the self-priming variable frequency screw pump, $\alpha$ is the additional safety factor, $P_{w,m}$ is the maximum pressure that the wellbore simulator can withstand, $\rho_{1,m}$ is the density of the liquid-phase fluid medium, $\mu_{1,m}$ is the kinematic viscosity of the liquid-phase fluid medium, $R_{w,m}$ is the radius of the wellbore simulator, $R_{p,m}$ is the radius of the drill string simulator, $h_{w,m}$ is the vertical height of the wellbore simulator, and $f$ is Fanning friction factor;

The set displacement value of the self-priming variable frequency screw pump in Step 2 is as follows:

$$Q_{1,m} = Q_{1,s}\left(\frac{R_{w,m}^2 - R_{p,m}^2}{R_{w,s}^2 - R_{p,s}^2}\right)\sqrt{\frac{R_{w,m}}{R_{w,s}}}$$

Where, $Q_{1,m}$ is the set value of the displacement of the self-priming variable frequency screw pump during the test, $Q_{1,s}$ is the displacement of the drilling pump in practical drilling operation, $R_{w,s}$ is the radius of the actual wellbore, and $R_{p,s}$ is the radius of the actual drill string;

Further, the set values respectively of the output pressure of the two-stage regulating valve and the safety pressure of the ferrule type relief valve are calculated as follows:

$$\begin{cases} \text{Gas conveying pressure} & P_{g,inj} = P_{g,tes} + P_{v,che} + \dfrac{\sigma_{1,m}L_z}{\pi R_{g,inj}^2} - 9.81\rho_e h_g \\ \text{Leakage pressure} & P_{1,los} = P_{1,tes} - 9.81\rho_e h_1 \end{cases}$$

Where, $P_{g,inj}$ is the output pressure of the two-stage pressure regulating valve (14), $P_{1,los}$ is the safety pressure of the ferrule-type relief valve, $P_{g,tes}$ is the test value of the annular pressure sensor at gas conveying point, $P_{1,tes}$ is the test value of the annular pressure sensor at the leakage point, $P_{v,che}$ is the set pressure of the ferrule type check valve, $\sigma_{1,m}$ is the surface tension of the liquid medium of the experiment, $L_z$ is the radial distance from the outlet of the ferrule type relief valve to the inner wall surface of the wellbore simulator, $R_{g,inj}$ is the inner radius of the gas conveying pipeline, $\rho_e$ is the set equivalent density difference, $h_g$ is the axial vertical height from the gas conveying pipeline to the top of the wellbore simulator, and $h_1$ is the axial vertical height from the medium leakage pipeline to the top of the wellbore simulator;

The density $\rho_{z,m}$ of the liquid medium during the well-kill simulation test in Step 6 is calculated as follows:

$$\rho_{z,m} = \frac{P_{p,sta}}{9.81h_g} + \rho_{1,m}$$

Where, $P_{p,sta}$ is the stable pressure data measured by the riser pressure sensor.

The beneficial effects of the present invention are as follows:

(1) For the experimental system of the present invention, the structural characteristics of the pores and fractures developed in the actual deep formation are fully considered, so that the movement characteristics of the liquid-phase fluid medium leakage and the gas-phase fluid medium intrusion are more in line with the actual condition, and the wellbore pressure tests can be completed in the same experimental system under three complex conditions: gas-kick and loss-circulation at the same interval, upper gas-kick and lower loss-circulation, and upper gas-kick and lower loss-circulation, making the experimental test results more in line with the actual condition and more pertinent;

(2) In the principle of experimental test, the present invention is highly consistent with the essential reason for the occurrence of complex working conditions, i.e., the pressure evolution test in the experimental system is mainly completed by adjusting the equivalent density difference, rather than manually adjusting the air intake and leakage rates, making the experimental test results more consistent with the actual condition;

(3) The experimental system of the present invention has a simple structure, with no special processing materials and test devices required, which can significantly reduce the costs associated with the construction of the experimental system without affecting the experimental test results;

(4) The experimental method of the present invention can comprehensively cover the three stages (circulating, shut-in and well killing) during the occurrence of coexistence of gas-kick and loss-circulation, multiple groups of experiments can be conducted by changing a single variable at the same stage, to obtain the different evolution characteristics of the wellbore pressure in the pressure balance failure stage and the pressure balance recovery stage, making the experimental test results applicable to all stages of wellbore pressure control in drilling operation.

1-liquid conveying module, 2-gas conveying module, 3-positive circulating liquid conveying pipeline, 4-reverse circulating liquid conveying pipeline, 5-liquid storage tank, 6-self-priming variable frequency screw pump, 7-electric liquid injection volume control valve, 8-injected liquid turbine flowmeter, 9-positive circulating injection control valve, 10-reverse circulating injection control valve, 11-reverse circulating end control valve, 12-gas conveying pipeline, 13-nitrogen cylinder, 14-two-stage pressure regulating valve, 15-digital mass flowmeter, 16-ferrule type check valve, 17-annular pressure sensor at gas conveying point, 18-medium return pipeline, 19-medium leakage module, 20-return medium turbine flowmeter, 21-electric return volume control valve, 22-gas-liquid separator, 23-medium leakage pipeline, 24-annular pressure sensor at leakage point, 25-ferrule type relief valve, 26-leakage medium turbine flowmeter, 27-secondary safeguard control valve, 28-recovery tank, 29-riser pressure sensor, 30-casing pressure sensor, 31-return medium blowout preventer, 32-drill string simulator, 33-wellbore simulator, 34-complex stratigraphic structure simulator, 35-upper flange, 36-central chamber, 37-lower flange, 38-housing cavity, 39-central pipe with uniformly distributed openings, 40-high-speed camera, 41-paperless recorder, 42-processing device.

DETAILED DESCRIPTION OF THE EMBODIMENTS

The present invention is further described with reference to the drawings and embodiments.

Figure 1:
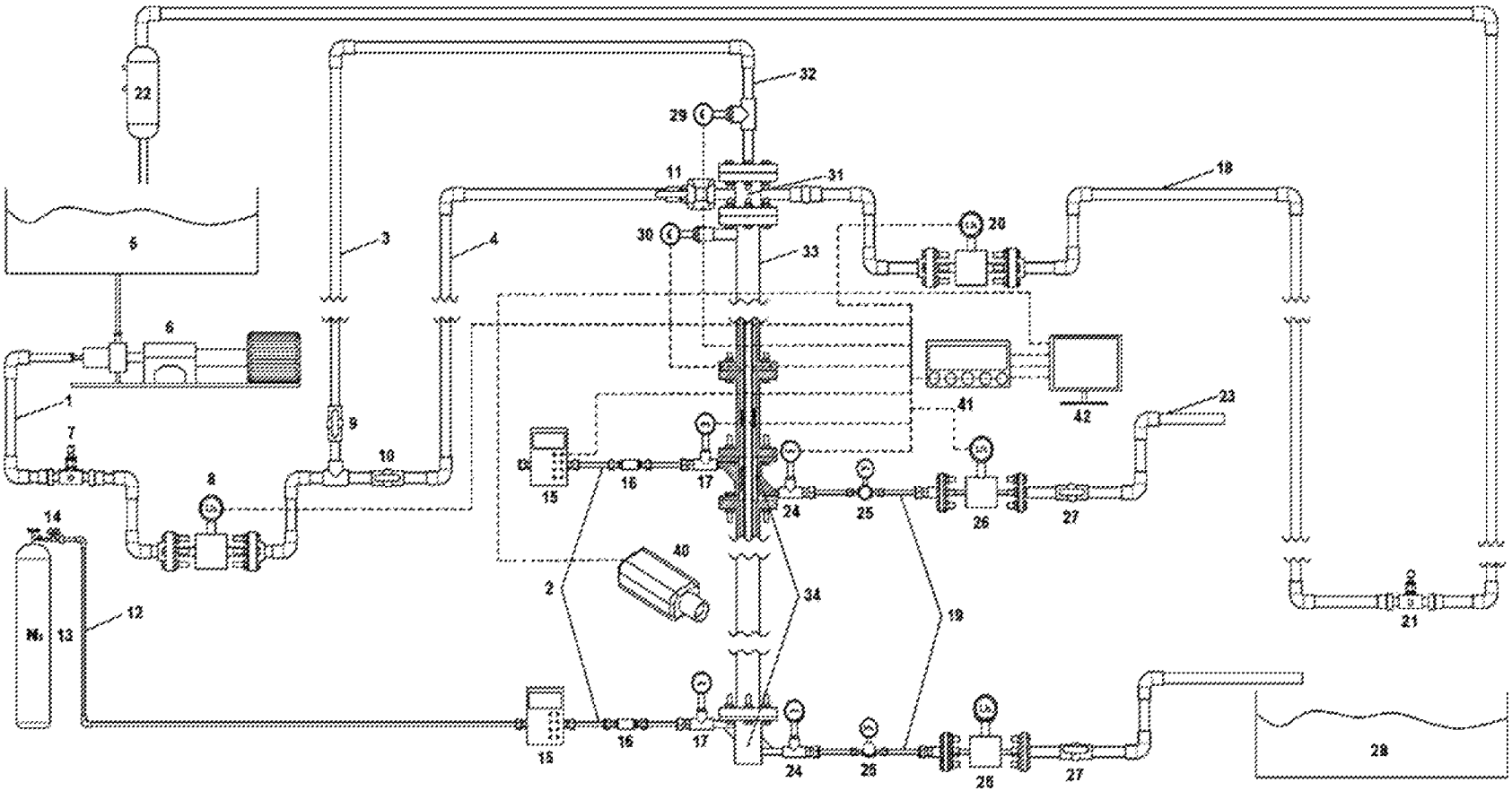
FIG. 1 is a schematic structural diagram of the experimental system of the present invention.

As shown in FIG. 1, an experimental system for wellbore pressure testing under the coexistence of gas-kick and loss-circulation comprises a drill string simulator (32), a transparent wellbore simulator (33) and a transparent complex stratigraphic structure simulator (34), wherein the complex stratigraphic structure simulator (34) is attached below the wellbore simulator, and the drill string simulator (32) is sleeved inside the wellbore simulator (33) and the complex stratigraphic structure simulator (34), with the upper end extending out of the wellbore simulator (33). The experimental system also comprises a liquid conveying module (1) for providing the liquid used in the experimental system and a gas conveying module (2) for providing the gas used in the experimental system.

The liquid conveying module (1) is composed of a positive circulating liquid conveying pipeline (3) connected to a liquid storage tank (5) at one end and to the upper end of the drill string simulator (32) at the other end, and a reverse circulating liquid conveying pipeline (4) connected to the liquid storage tank (5) at one end and the wellbore simulator (33) at the other end. The liquid conveying module (1) also comprises a liquid conveying pipeline with one end connected to a liquid storage tank (5) through a self-priming variable frequency screw pump (6) and the other end connected to a positive circulating liquid conveying pipeline (3) and a reverse circulating liquid conveying pipeline (4) through a PVC three-way valve; the liquid conveying pipeline is also provided with an electric liquid injection volume control valve (7) and an injected liquid turbine flowmeter (8); the device on the liquid conveying pipeline is connected to an acrylic PMMA tube through a high-pressure explosion-proof rubber hose, and the corner and connection are connected by high-pressure explosion proof rubber hose. The positive circulating liquid conveying pipeline (3) is equipped with a positive circulating injection control valve (9) at one end near the three-way valve; the reverse circulating liquid conveying pipeline (4) is equipped with a reverse circulating injection control valve (10) at the end near the three-way valve and a reverse circulating end control valve (11) at the end near the wellbore simulator (33). The positive circulating liquid conveying pipeline (3) and the reverse circulating liquid conveying pipeline (4) are made of acrylic PMMA tubes.

The gas conveying module (2) comprises two gas conveying pipelines (12) of the same structure, both with the head end connected to the nitrogen cylinder (13) and the rear end connected to the upper position of the complex stratigraphic structure simulator (34); a two-stage pressure regulating valve (14), a digital mass flowmeter (15), a ferrule type check valve (16) and an annular pressure sensor at gas conveying point (17) are arranged in sequence from one end of the nitrogen cylinder (13) to the other end on the gas conveying pipeline (12). One of the two gas conveying pipelines (12) is set at 0.2 m from the bottom of the experimental system, and the other at 2.2 m from the bottom of the experimental system. The devices on the gas conveying pipeline (12) are connected with a PU hose through a seamless steel pipe, and the corner and connection are connected by a PU hose.

The experimental system further comprises a medium return pipeline (18) for collecting the returning test liquid and a medium leakage module (19) for collecting the leaking test liquid, wherein one end of the medium return pipeline (18) is connected to the upper end of the wellbore simulator (33) and the other end is connected to the liquid storage tank (5) through a gas-liquid separator (22). The medium return pipeline (18) is provided with a return medium turbine flowmeter (20) and an electric return volume control valve (21). The medium return pipeline (18) is made of acrylic PMMA tube.

The medium leakage module (19) includes two medium leakage pipelines (23) of the same structure, both with the head end connected to the lower part of the complex stratigraphic structure simulator (34) and the rear end connected to the recovery tank (28); an annular pressure sensor at leakage point (24), a ferrule type relief valve (25), a leakage medium turbine flowmeter (26) and a secondary safeguard control valve (27) are sequentially arranged on the medium leakage pipeline (23). The two medium leakage pipelines (23) are set at the bottom of the experimental system and 2.0 m from the bottom, respectively. The devices on the two medium leakage pipelines (23) are connected by a seamless steel pipe and a ferrule-type flange.

The experimental system further comprises a data acquisition system which is composed of a flowmeter used for acquiring the flow rate and a pressure sensor for acquiring the gas pressure of the two pipelines in the liquid conveying process of liquid conveying module (1) and in the gas conveying process of gas conveying module (2), a flowmeter used for acquiring the flow rate in the medium return pipeline (18) and the medium leakage pipeline (23) and a pressure sensor for acquiring the gas pressure of the two pipelines, a riser pressure sensor (29) used for acquiring the pressure of the drill string simulator (32), a casing pressure sensor (30) used for acquiring the pressure during the testing of the wellbore simulator (33), and a high-speed camera (40) used to capture images of liquid annulus flow between the wellbore simulator (33) and the drill string simulator (32), wherein the flowmeters, pressure sensors and high-camera (40) are connected to the processing device (42) via a paperless recorder (41).

The riser pressure sensor (29) is installed at the top of the drill string simulator (32) through a T-branch pipe with inner copper thread. The casing pressure sensor (30) is installed at the top branch pipe of the wellbore simulator (3) through a two-way pipe with inner copper thread.

Figure 2:
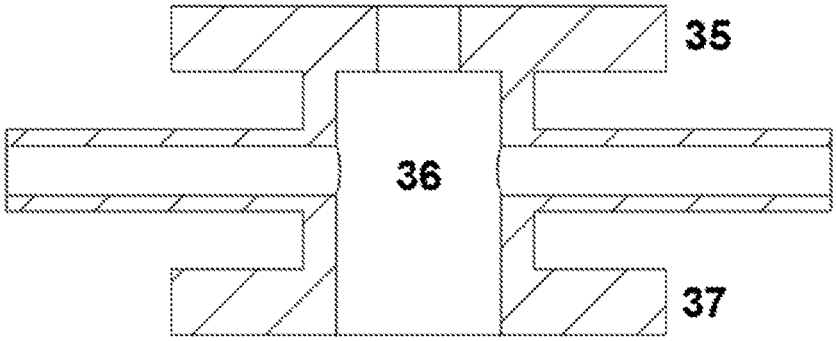
FIG. 2 is a sectional view of the return medium blowout preventer in the experimental system of the present invention.
Figure 3:
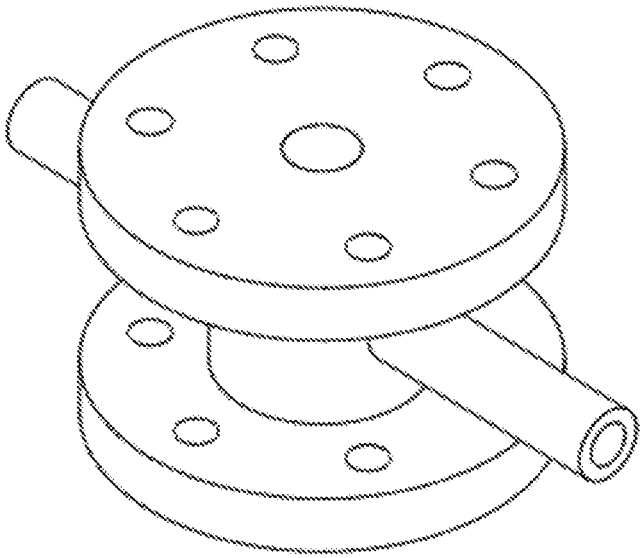
FIG. 3 is an axonometric view of the return medium blowout preventer in the experimental system of the present invention.
Figure 4:
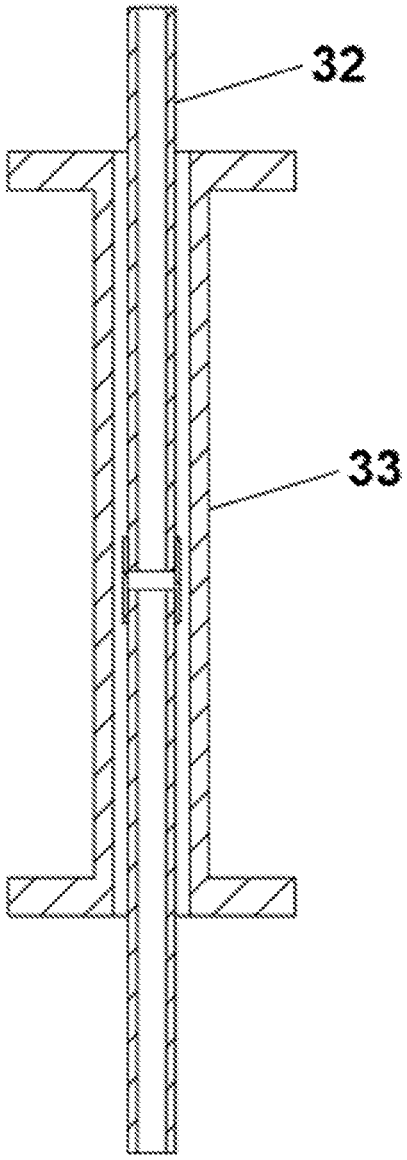
FIG. 4 is a schematic structural diagram of the drill string and the wellbore simulator in the experimental system of the present invention.
Figure 5:
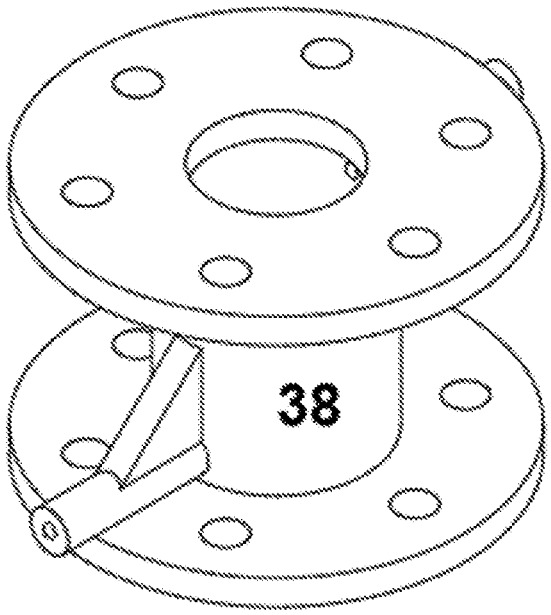
FIG. 5 is a schematic structural diagram of the housing cavity structure of the complex stratigraphic structure simulator in the experimental system of the present invention.
Figure 6:
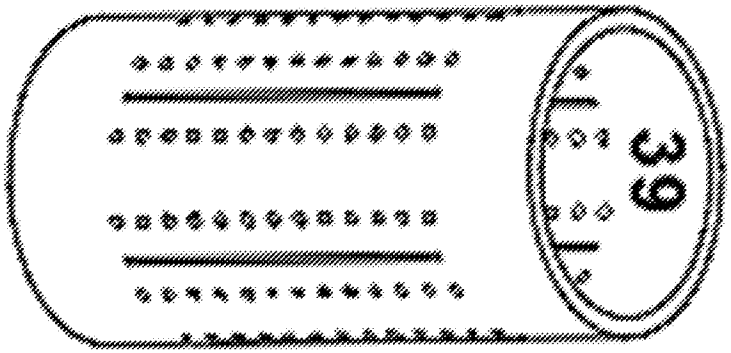
FIG. 6 is a schematic structural diagram of the central pipe with uniformly distributed openings of the complex stratigraphic structure simulator in the experimental system of the present invention.

The drill string simulator (32) and the wellbore simulator (33) are connected by a return medium blowout preventer (31) of which the structure is shown in FIG. 2 and FIG. 3. The return medium blowout preventer (31) is composed of an upper flange, a central chamber and a lower flange; the drill string simulator (32) passes through the central holes of the upper flange (35) and the lower flange (37) successively; the opposite sides of the central chamber (36) are respectively provided with a left branch pipe and a right branch pipe, the left branch pipe is connected to the reverse circulating end control valve (11), and the right branch pipe is communicated with the medium return pipe (18) through a PVC two-way pipe. The diameter of the central hole of the upper flange (35) is the same as the outer diameter of the drill string simulator (32). The diameter of the central hole of the lower flange (37) is the same as the inner diameter of the wellbore simulator (33). The drill string simulator (32) is wall-connected with the central hole of the upper flange (35) of the return medium blowout preventer (31) by acrylic adhesive. The top is connected to the positive circulating liquid conveying pipeline (3) through a T-branch pipe with inner copper thread connected to the riser pressure sensor (29), and the overall vertical height is 6.8 m. The suspension height between the bottom of the drill string simulator (32) and the bottom of the experimental system is 0.1 m. The drill string section 2.0 m upward from the bottom is divided into two sections, each with a length of 1.0 m. The adjacent single sections of the drill string are socket-connected by a PVC two-way pipe. The drill string section from the node with a height of 2.0 m up to its top is divided into 3 sections, each with a length of 1.6 m. The adjacent single sections of the drill string are connected by a PVC two-way pipe and bonded by acrylic adhesive. The wellbore simulator (33) was divided into four sections, with the upper two sections each having a length of 2.0 m and the lower two sections each having a length of 1.0 m. The adjacent single-sections of the wellbore are connected to each other by flanges and form a concentric annular string together with the drill string simulator (32).

There are two complex stratigraphic structure simulators (43), which are flanged to the bottom of the experimental system and 2.0 m upward from the bottom, respectively. The complex stratigraphic structure simulator consists of a housing cavity (38) and a central pipe with uniformly distributed openings (39) set inside thereof; the central pipe with uniformly distributed openings (39) is vertically provided with N slits (N=6), and there are openings evenly distributed between adjacent slits along the axial direction of the central pipe with uniformly distributed openings (39); two rows of openings are made between two adjacent slits, and arranged in a periodic array. The diameters of the central holes of the upper and lower flanges of the housing cavity (38) are the same as the outer diameter of the central pipe with uniformly distributed openings (39). The inner diameter of the intermediate main structure is the same as the outer diameter of the single section of the wellbore in the wellbore simulator (33). The upper branch pipe of the intermediate main structure is connected to the gas conveying pipeline (12) through a socket connection, and the lower branch pipe is connected to the medium leakage pipeline (23) through a socket connection. The central pipe with uniformly distributed openings (39) is vertically provided with 6 groups of the same opening structure, and a single vertical slit is arranged in the middle of the opening structure of the same group. The openings are arranged on both sides of the vertical slit and are evenly distributed in the axial direction. There is an angle of 15° between the single opening in the same group and the line connecting the center points of the central pipe with uniformly distributed openings (39) on the same horizontal plane, the combined area of the openings at the same height is the same as the cross-sectional area of the single upper and lower branch pipes of the casing cavity (38), and there is an angle of 60° between the connecting lines between the center point of the openings of different groups and the center point of the central pipe with uniformly distributed openings (39) on the same horizontal plane.

When in use, the liquid-phase fluid medium stored in the liquid storage tank (5) and the gas-phase fluid medium stored in the standard nitrogen cylinder (13) will be injected into the annulus between the drill string simulator (32) and the wellbore simulator (33) by the self-priming variable frequency screw pump (6) and the two-stage regulating valve (14), respectively. A part of the two-phase fluid media will leak into the recovery tank (28) through the medium leakage pipeline (23), and the other part of the two-phase fluid medium will be separated by the gas-liquid separator (22) after passing through the medium return pipeline (18) and returned to the liquid storage tank (5) to participate in the next cycle again. After the annular pressure between the drill string simulator (32) and the wellbore simulator (33) presents an obvious evolution cycle, turn off the self-priming variable frequency screw pump (6) and the electric return volume control valve (21), and conduct a shut-in simulation test. After the annular pressure between the drill string simulator (32) and the wellbore simulator (33) shows an obvious evolution cycle again, turn on the self-priming variable frequency screw pump (6) and the electric return volume control valve (21) again. Perform the well-kill simulation test at the displacement set in the experimental test. Record the experimental test results with the high-speed camera (40), the paperless recorder (41) and the processing device (42) at the end of each stage.

The specific experimental method and process are as follows:

Step 1: Connect the system, and install the gas phase transport pipeline (12) and media leakage pipeline (23) on the associated branch pipes of the complex stratigraphic structure simulator (34) at the bottom of the wellbore simulator (33), respectively. Add a certain amount of calcium chloride particles successively in the water in the liquid storage tank (5) to adjust the density of the liquid-phase fluid medium used in the experimental test, successively take a portion of the liquid-phase fluid medium after blending into a beaker, and place the breaker on an electronic balance for weighing. Make sure that the density of the prepared liquid-phase fluid medium reaches the set value of the experimental test.

Gradually add a certain amount of sodium carboxymethyl cellulose particles to the water in the liquid storage tank (5) to adjust the kinematic viscosity of the liquid-phase fluid medium used in the experimental test, and successively take a portion of the liquid-phase fluid medium after the blending into the rotational viscometer for measuring, and ensure that the kinematic viscosity of the prepared liquid-phase fluid medium reaches the set value of the experimental test.

Upon the installation of the experimental system and the preparation of the liquid-phase fluid medium, set the electric liquid injection volume control valve (7), the positive circulating injection control valve (9) and the electric return volume control valve (21) to fully open, keep all other control valves on the pipe closed, and set the safety pressure of the ferrule type relief valve (25) to the maximum.

Perform Circulating Simulation Test:

Step 2: Turn on the self-priming variable frequency screw pump (6), and gradually increase its output power until its liquid injection displacement reaches the limit value of the experimental system. Fill the wellbore simulator (33) with the liquid-phase fluid medium quickly, and check whether there is liquid leakage at each connection point on the experimental system in the experimental test stage to ensure that the whole experimental system is in intact sealing.

The maximum liquid injection displacement of the self-priming inverter screw pump (6) is calculated as follows:

$$\begin{cases} \text{Laminar flow} & Q_{1,max} = \alpha\pi\left(R_{w,m}^2 - R_{p,m}^2\right)\dfrac{(P_{w,m} - 9.81\rho_{1,m}h_{w,m})(R_{w,m} - R_{p,m})^2}{12\mu_{1,m}h_{w,m}} \\ \text{Turbulent flow} & Q_{1,max} = \alpha\pi\left(R_{w,m}^2 - R_{p,m}^2\right)\sqrt{\dfrac{(P_{w,m} - 9.81\rho_{1,m}h_{w,m})(R_{w,m} - R_{p,m})}{fh_{w,m}\rho_{1,m}}} \end{cases}$$

Where, $Q_{1,max}$ is the maximum injection and displacement volume of the self-priming variable frequency screw pump (6), in $m^3/s$, $\alpha$ is the additional safety factor, and taken as 0.6 to 0.8; $P_{w,m}$ is the maximum pressure that the wellbore simulator (33) can withstand, in Pa, $\rho_{1,m}$ is the density of the liquid-phase fluid medium, in $kg/m^3$, $\mu_{1,m}$ is the kinematic viscosity of the liquid-phase fluid medium, in Pa·s, $R_{w,m}$ is the radius of the wellbore simulator (33), in m, $R_{p,m}$ is the radius of the drill string simulator (32), in m, $h_{w,m}$ is the vertical height of the wellbore simulator, in m, and $f$ is Fanning friction factor.

When the liquid-phase fluid medium can circulate smoothly in the experimental system, without liquid leakage, gradually adjust the displacement of the self-priming variable frequency screw pump (6) to the set value of the experimental test. The set displacement value of the self-priming variable frequency screw pump (6) in the experimental test is calculated as follows:

$$Q_{1,m} = Q_{1,s}\left(\frac{R_{w,m}^2 - R_{p,m}^2}{R_{w,s}^2 - R_{p,s}^2}\right)\sqrt{\frac{R_{w,m}}{R_{w,s}}}$$

Where, $Q_{1,m}$ is the set value of the displacement of the self-priming variable frequency screw pump (6) during the test, in $m^3/s$; $Q_{1,s}$ is the displacement of the drilling pump in practical drilling operation, in $m^3/s$; $R_{w,s}$ is the radius of the actual wellbore, in m, and $R_{p,s}$ is the radius of the actual drill string, in m.

Step 3: After the transient pressure data shown by the annular pressure sensor at gas conveying point (17) and the annular pressure sensor at leakage point (24) are stabilized, adjust the output pressure of the two-stage regulating valve (14) and the safety pressure of the ferrule relief valve (25) simultaneously to the set experimental values according to the equivalent density difference set in the experimental test; ensure that the gas conveying pressure and the leakage pressure remain stable during the experimental test. The set values respectively of the output pressure of the two-stage regulating valve (14) and the safety pressure of the ferrule type relief valve (25) in the experimental test are calculated as follows:

$$\begin{cases} \text{Gas conveying pressure} & : P_{g,inj} = P_{g,tes} + P_{v,che} + \dfrac{\sigma_{1,m}L_z}{\pi R_{g,inj}^2} - 9.81\rho_e h_g \\ \text{Leakage pressure} & : P_{1,los} = P_{1,tes} - 9.81\rho_e h_1 \end{cases}$$

Where, $P_{g,inj}$ is the output pressure of the two-stage pressure regulating valve (14), in Pa, $P_{1,los}$ is the safety pressure of the ferrule-type relief valve (25), in Pa, $P_{g,tes}$ is the test value of the annular pressure sensor at gas conveying point, in Pa, $P_{1,tes}$ is the test value of the annular pressure sensor at the leakage point, in Pa, $P_{v,che}$ is the set pressure of the ferrule type check valve, in Pa, $\sigma_{1,m}$ is the surface tension of the liquid medium of the experiment, in N/m, $L_z$ is the radial distance from the outlet of the ferrule type relief valve to the inner wall surface of the wellbore simulator (33), in m, $R_{g,inj}$ is the inner radius of the gas conveying pipeline, in m, $\rho_e$ is the set equivalent density difference, in $kg/m^3$, $h_g$ is the axial vertical height from the gas conveying pipeline to the top of the wellbore simulator (33), in m, and $h_1$ is the axial vertical height from the medium leakage pipeline to the top of the wellbore simulator (33), in m.

Step 4: Gradually open the nitrogen cylinder (13) and the secondary safeguard control valve (27) set at the head end of the gas conveying pipeline (12); the output pressure of the nitrogen cylinder (13) after the primary pressure regulation should be 10% of the unregulated pressure. Turn on the data acquisition system, and observe the evolution pattern of the experimental test data recorded on the paperless recorder (41) in real time; after the transient pressure data transmitted by the annular pressure sensor at leakage point (24) present three test cycles with obvious evolution patterns, use the processing device (42) to promptly save the transient experimental data recorded by the high-speed camera (40) and the paperless recorder (41) at the current experimental test stage, to complete the circulating simulation test.

Perform Shut-In Simulation Test

Step 5: Gradually turn off the self-priming variable frequency screw pump (6) and the electric return volume control valve (21); after the transient pressure data transmitted by the annular pressure sensor at leakage point (24) present three test cycles with obvious evolution patterns, use the processing device (42) to promptly save the transient experimental data recorded by the high-speed camera (40) and the paperless recorder (41) at the current experimental test stage, to prepare for the well-kill simulation test.

Perform Well-Kill Simulation Test

Step 6: Work out the density of the weighted liquid medium required for the next stage of the well-kill simulation test based on the relatively stable transient pressure data transmitted by the riser pressure sensor (29) during the shut-in simulation test. The density $\rho_{z,m}$ of the liquid medium is calculated as follows:

$$\rho_{z,m} = \frac{P_{p,sta}}{9.81h_g} + \rho_{1,m}$$

Where, $P_{p,sta}$ is the stable pressure data measured by the riser pressure sensor, in Pa.

Gradually add calcium chloride particles to the liquid-phase fluid medium in the liquid storage tank (5) again, making the density of the liquid-phase fluid medium reach the obtained density of the weighted liquid-phase fluid medium, and get ready to carry out the experimental test for the evolution pattern of wellbore pressure when applying the engineering method to well killing operation under the coexistence of gas-kick and loss-circulation.

Gradually turn on the self-priming variable frequency screw pump (6) and adjust the opening of the electric return volume control valve (21) to make the transient pressure data acquired by the casing pressure sensor (30) consistent with the final stable transient pressure data obtained in Step 5, and then continually adjust the self-priming variable frequency screw pump (6) until the liquid injection displacement reaches ⅓ to ½ of the liquid injection displacement during the circulating simulation test.

Step 7: In the process of the liquid medium flowing from the top of the drill string simulator (32) to the bottom, keep the liquid injection displacement of the self-priming variable frequency screw pump (6) unchanged, and adjust the electric return volume control valve (21) to gradually decrease the transient pressure data obtained from the riser pressure sensor (29).

Step 8: In the process of the liquid-phase fluid medium flowing upward from the bottom along the annulus between the wellbore simulator (33) and the drill string simulator (32), keep the liquid injection displacement of the self-priming variable frequency screw pump (6) unchanged, and adjust the electric return volume control valve (21) to equalize the data acquired by the riser pressure sensor (29) with the final transient data in Step 7.

Step 9: When the liquid flows out of the medium leakage pipeline steadily, adjust the safety pressure of the ferrule type relief valve (25) to the maximum value; when the liquid flows out from the medium return pipeline (18), slowly shut down the self-priming variable frequency screw pump (6) and the electric return volume control valve (21); record the transient experimental data with the processing device (42);

Step 10: Inject the set liquid-phase fluid medium into the liquid storage tank (5), turn on the self-priming variable frequency screw pump (6), and adjust the opening of the electric return volume control valve (21) to make the transient data acquired by the riser pressure sensor (29) equal to the final transient data obtained in Step 7 until the liquid injection displacement of the self-priming variable frequency screw pump (6) reaches the set value.

Step 11: When the liquid flows out from the medium return pipeline (18), adjust the opening of the electric return volume control valve (21) to keep the transient data acquired by the casing pressure sensor (29) stable;

Step 12: Repeat Steps 6 to 9;

Step 13: Change the experimental variables, such as the density, kinematic viscosity and injection displacement of the liquid-phase fluid medium. Repeat Steps 1 to (12). Then adjust the relative positions of the gas conveying pipeline (12) and the medium leakage pipeline (23), that is, connect the gas conveying pipeline (12) and the medium leakage pipeline (23) to the associated branch pipes of different complex stratigraphic structure simulators (34) respectively, and repeat Steps 1 to 12 to further complete the experimental test of the wellbore pressure evolution pattern under two different forms of complex working conditions: upper gas-kick and lower loss-circulation, and upper loss-circulation and lower gas-kick.

The raw materials of the experimental system and relevant test device used in the present invention are simple and easily available, with no special processing materials and test devices required, which can significantly reduce the costs associated with the construction of the experimental system without affecting the experimental test results. The structural characteristics of the pores and fractures developed in the actual deep formation are fully considered in the design of the experimental system, so that the movement characteristics of the liquid-phase fluid medium leakage and the gas-phase fluid medium intrusion are more in line with the actual condition, and the wellbore pressure tests can be completed in the same experimental system under three complex conditions: gas-kick and loss-circulation at the same interval, upper gas-kick and lower loss-circulation, and upper gas-kick and lower loss-circulation, making the experimental test results more in line with the actual condition and more pertinent. In principle, the experimental test is highly consistent with the essential reason for the occurrence of complex working conditions, i.e., the pressure evolution test in the experimental system is mainly completed by adjusting the equivalent density difference, rather than manually adjusting the air intake and leakage rates, making the experimental test results more consistent with the actual condition. In terms of method, the experimental test comprehensively covers the three stages (circulating, shut-in and well killing) during the occurrence of coexistence of gas-kick and loss-circulation, multiple groups of experiments can be conducted by changing a single variable at the same stage, to obtain the different evolution characteristics of the wellbore pressure in the pressure balance failure stage and the pressure balance recovery stage, making the experimental test results applicable to all stages of wellbore pressure control in drilling operation.

What is claimed is:

1. An experimental system and a method for wellbore pressure testing under the coexistence of gas-kick and loss-circulation, comprising a drill string simulator (32), a transparent wellbore simulator (33) and a transparent complex stratigraphic structure simulator (34); the complex stratigraphic structure simulator (34) is attached below the wellbore simulator (33), and the drill string simulator (32) is sleeved inside the wellbore simulator (33) and the complex stratigraphic structure simulator (34), with the upper end extending out of the wellbore simulator (33);

Further comprising a liquid conveying module (1) for providing the liquid used in the experimental system and a gas conveying module (2) for providing the gas used in the experimental system;

The liquid conveying module (1) is composed of a positive circulating liquid conveying pipeline (3) connected to a liquid storage tank (5) at one end and to the upper end of the drill string simulator (32) at the other end, and a reverse circulating liquid conveying pipeline (4) connected to the liquid storage tank (5) at one end and the wellbore simulator (33) at the other end; the gas conveying module (2) comprises two gas conveying pipelines (12) of the same structure, both with the head end connected to the nitrogen cylinder (13) and the rear end connected to the upper position of the complex stratigraphic structure simulator (34);

Further comprising a medium return pipeline (18) for collecting the returning test liquid and a medium leakage module (19) for collecting the leaking test liquid; one end of the medium return pipeline (18) is connected to the upper end of the wellbore simulator (33) and the other end is connected to the liquid storage tank (5) through a gas-liquid separator (22); the medium leakage module (19) comprises two medium leakage pipelines (23) of the same structure, both with the head end connected to the lower part of the complex stratigraphic structure simulator (34) and the rear end connected to the recovery tank (28);

Further comprising a data acquisition system which is composed of flowmeters used for acquiring the flow rate and pressure sensors for acquiring the pressure in the liquid conveying process of liquid conveying module (1) and in the gas conveying process of gas conveying module (2); further comprising a return medium turbine flowmeter (20) and a leakage medium turbine flowmeter (26) used for acquiring the flow rate in the medium return pipeline (18) and the two medium leakage pipelines (23) respectively, and an annular pressure sensor (24) for acquiring the gas pressure of the two medium leakage pipe-lines (23); further comprising a riser pressure sensor (29) used for acquiring the pressure of the drill string simulator (32), a casing pressure sensor (30) used for acquiring the pressure during the testing of the wellbore simulator (33); further comprising a high-speed camera (40) used to capture images of liquid annulus flow between the wellbore simulator (33) and the drill string simulator (34); wherein the flowmeters, the return medium turbine flowmeter (20), the leakage medium turbine flowmeter (26), the pressure sensors, the annular pressure sensor (24) and the high-speed camera (40) are connected to a processing device (42) via a paperless recorder (41); and wherein a two-stage pressure regulating valve (14), a digital mass flowmeter (15), a ferrule type check valve (16) and an annular pressure sensor (17) are arranged in sequence from one end of the nitrogen cylinder (13) to the other end on the gas conveying pipeline (12).

2. The experimental system for wellbore pressure testing under the coexistence of gas-kick and loss-circulation according to claim 1, wherein the liquid conveying module (1) comprises a liquid conveying pipeline with one end connected to a liquid storage tank (5) through a self-priming variable frequency screw pump (6) and the other end connected to a positive circulating liquid conveying pipeline (3) and a reverse circulating liquid conveying pipeline (4) through a three-way valve; the liquid conveying pipeline is also provided with an electric liquid injection volume control valve (7) and an injected liquid turbine flowmeter (8); the positive circulating liquid conveying pipeline (3) is provided with a positive circulating injection control valve (9) at the end near the three-way valve end; the reverse circulating liquid conveying pipeline (4) is provided with a reverse circulating injection control valve (10) at the end near the three-way valve end, and provided with a reverse circulating end control valve (11) at the end near the wellbore simulator (33).

3. The experimental system for wellbore pressure testing under the coexistence of gas-kick and loss-circulation according to claim 2, wherein the annular pressure sensor (24) at leakage point, a ferrule type relief valve (25), the leakage medium turbine flowmeter (26) and a secondary safeguard control valve (27) are sequentially arranged on the medium leakage pipeline (23).

4. The experimental system for wellbore pressure testing under the coexistence of gas-kick and loss-circulation according to claim 3, wherein the medium return pipeline (18) is provided with the return medium turbine flowmeter (20) and an electric return volume control valve (21).

5. The experimental system for wellbore pressure testing under the coexistence of gaskick and loss-circulation according to claim 4, wherein the drill string simulator (32) and the wellbore simulator (33) are connected through a return medium blowout preventer (31); the return medium blowout preventer (31) is composed of an upper flange (35), a central chamber (36) and a lower flange (37); the drill string simulator (32) passes through the central holes of the upper flange (35) and the lower flange (37) successively; the opposite sides of the central chamber (36) are respectively provided with a left branch pipe and a right branch pipe, the left branch pipe is connected to the reverse circulating end control valve (11), and the right branch pipe is communicated with the medium return pipe (18).

6. The experimental system for wellbore pressure testing under the coexistence of gas-kick and loss-circulation according to claim 5, wherein the complex stratigraphic structure simulator (34) consists of a housing cavity (38) and a central pipe with uniformly distributed openings (39) set inside thereof; the central pipe with uniformly distributed openings (39) is vertically provided with N slits, and there are openings evenly distributed between adjacent slits along the axial direction of the central pipe with uniformly distributed openings (39); the gas conveying pipeline (12) is communicated with the first branch pipe arranged on the housing cavity (38); the medium leakage pipeline (23) is communicated with the second branch pipe arranged on the opposite side of the housing cavity (38).

7. An experimental method for an experimental system for wellbore pressure testing under the coexistence of gas-kick and loss-circulation according to claim 6, comprising the following steps:

Step 1: Connect the system and add the prepared liquid in the liquid storage tank (5); set the electric liquid injection volume control valve (7), the positive circulating injection control valve (9) and the electric return volume control valve (21) to fully open, keep all other control valves on the pipe closed, and set the safety pressure of the ferrule type relief valve (25) to the maximum;

Step 2: Turn on the self-priming variable frequency screw pump (6) to the maximum liquid injection displacement, and check the tightness of the experimental system; if there is no liquid leakage, adjust the displacement of the self-priming variable frequency screw pump (6) to the set value;

Step 3: After the transient pressure data shown by the annular pressure sensor at gas conveying point (17) and the annular pressure sensor at leakage point (24) are stabilized, adjust the output pressure of the two-stage regulating valve (14) and the safety pressure of the ferrule relief valve (25) simultaneously to the set experimental values according to the equivalent density difference set in the experimental test;

Step 4: Open the nitrogen cylinder (13), turn on the secondary safeguard control valve (27), and set the output pressure of the nitrogen cylinder (13) to the set value; start up the data acquisition system, and record the various transient pressures of the experimental test after the transient pressure of the annular pressure sensor (24) at leakage point obtained by the processing device (42) meets the requirements, to complete the circulating simulation test;

Step 5: Turn off the self-priming variable frequency screw pump (6) and the electric return volume control valve (21), and record the various transient pressures of the experimental test after the transient pressure of the annular pressure sensor (24) at leakage point obtained by the processing device (42) meets the requirements, to complete the shut-in simulation test;

Step 6: Acquire the density of the liquid medium used in the well-kill simulation test and adjust the liquid in the liquid storage tank (5) according to the density; start the self-priming variable frequency screw pump (6), adjust the opening of the electric return volume control valve (21) to make the transient pressure data obtained by the casing pressure sensor (30) consistent with the transient pressure data acquired in Step 5, and continually adjust the self-priming variable frequency screw pump (6) until it reaches the set value;

Step 7: In the process of the liquid medium flowing from the top of the drill string simulator (32) to the bottom, keep the liquid injection displacement of the self-priming variable frequency screw pump (6) unchanged, and adjust the electric return volume control valve (21)

to gradually decrease the transient pressure data obtained from the riser pressure sensor (29);

Step 8: In the process of the liquid-phase fluid medium flowing upward from the bottom along the annulus between the wellbore simulator (33) and the drill string simulator (32), keep the liquid injection displacement of the self-priming variable frequency screw pump (6) unchanged, and adjust the electric return volume control valve (21) to equalize the data acquired by the riser pressure sensor (29) with the final transient data in Step 7;

Step 9: When the liquid flows out of the medium leakage pipeline steadily, adjust the safety pressure of the ferrule type relief valve (25) to the maximum value; when the liquid flows out from the medium return pipeline (18), slowly shut down the self-priming variable frequency screw pump (6) and the electric return volume control valve (21); record the transient experimental data with the processing device (42);

Step 10: Inject the set liquid-phase fluid medium into the liquid storage tank (5), turn on the self-priming variable frequency screw pump (6), and adjust the opening of the electric return volume control valve (21) to make the transient data acquired by the riser pressure sensor (29) equal to the final transient data obtained in Step 7 until the liquid injection displacement of the self-priming variable frequency screw pump (6) reaches the set value;

Step 11: When the liquid flows out from the medium return pipeline (18), adjust the opening of the electric return volume control valve (21) to keep the transient data acquired by the casing pressure sensor (29) stable;

Step 12: Repeat Steps 6 to 9;

Step 13: Adjust the liquid in the liquid storage tank (5), repeat Steps 1 to 12, and adjust the relative positions of the gas pipe (12) and the medium leakage pipeline (23); then repeat Steps 1 to 12 to complete the experiment.

8. The experimental method for wellbore pressure testing under the coexistence of gas-kick and loss-circulation according to claim 7, wherein the maximum liquid injection displacement of the self-priming inverter screw pump (6) in Step 2 is calculated as follows:

$$\begin{cases} \text{Laminar flow} & Q_{1,max} = \alpha\pi\left(R_{w,m}^2 - R_{p,m}^2\right)\dfrac{(P_{w,m} - 9.81\rho_{1,m}h_{w,m})(R_{w,m} - R_{p,m})^2}{12\mu_{1,m}h_{w,m}} \\ \text{Turbulent flow} & Q_{1,max} = \alpha\pi\left(R_{w,m}^2 - R_{p,m}^2\right)\sqrt{\dfrac{(P_{w,m} - 9.81\rho_{1,m}h_{w,m})(R_{w,m} - R_{p,m})}{fh_{w,m}\rho_{1,m}}} \end{cases}$$

Where, $Q_{1,max}$ is the maximum injection displacement volume of the self-priming variable frequency screw pump (6), $\alpha$ is the additional safety factor, $P_{w,m}$ is the maximum pressure that the wellbore simulator (33) can withstand, $\rho_{1,m}$ is the density of the liquid-phase fluid medium, $\mu_{1,m}$ is the kinematic viscosity of the liquid-phase fluid medium, $R_{w,m}$ is the radius of the wellbore simulator (33), $R_{p,m}$ is the radius of the drill string simulator (32), $h_{w,m}$ is the vertical height of the wellbore simulator, and f is Fanning friction factor;

The set displacement value of the self-priming variable frequency screw pump (6) in Step 2 is as follows:

$$Q_{1,m} = Q_{1,s}\left(\frac{R_{w,m}^2 - R_{p,m}^2}{R_{w,s}^2 - R_{p,s}^2}\right)\sqrt{\frac{R_{w,m}}{R_{w,s}}}$$

Where, $Q_{1,m}$ is the set value of the displacement of the self-priming variable frequency screw pump (6) during the test, $Q_{1,s}$ is the displacement of the drilling pump in practical drilling operation, $R_{w,s}$ is the radius of the actual wellbore, and $R_{p,s}$ is the radius of the actual drill string.

9. The experimental method for wellbore pressure testing under the coexistence of gaskick and loss-circulation according to claim 8, wherein the set values respectively of the output pressure of the two-stage regulating valve (14) and the safety pressure of the ferrule type relief valve (25) are calculated as follows:

$$\begin{cases} \text{Gas conveying pressure} : P_{g,inj} = P_{g,tes} + P_{v,che} + \dfrac{\sigma_{1,m}L_z}{\pi R_{g,inj}^2} - 9.81\rho_e h_g \\ \text{Leakage pressure} : P_{1,los} = P_{1,tes} - 9.81\rho_e h_1 \end{cases}$$

Where, $P_{g,inj}$ is the output pressure of the two-stage pressure regulating valve (14), $P_{I,los}$ is the safety pressure of the ferrule-type relief valve (25), $P_{g,tes}$ is the test value of the annular pressure sensor at gas conveying point, $P_{1,tes}$ is the test value of the annular pressure sensor at the leakage point, $P_{v,che}$ is the set pressure of the ferrule type check valve, $\sigma_{1,m}$ is the surface tension of the liquid medium of the experiment, $L_Z$ is the radial distance from the outlet of the ferrule type relief valve to the inner wall surface of the wellbore simulator (33), $R_{g,inj}$ is the inner radius of the gas conveying pipeline, $\rho_e$ is the set equivalent density difference, $h_g$ is the axial vertical height from the gas conveying pipeline to the top of the wellbore simulator (33), and $h_1$ is the axial vertical height from the medium leakage pipeline to the top of the wellbore simulator (33);

The density $\rho_{z,m}$ of the liquid medium during the well-kill simulation test in Step 6 is calculated as follows:

$$\rho_{z,m} = \frac{P_{p,sta}}{9.81h_g} + \rho_{1,m}$$

Where, $P_{p,sta}$ is the stable pressure data measured by the riser pressure sensor.

* * * * *